US005599170A

United States Patent [19]

Marchi et al.

[11] Patent Number: 5,599,170

[45] Date of Patent: Feb. 4, 1997

[54] SEAL FOR GAS TURBINE ROTOR BLADES

[75] Inventors: Marc R. Marchi, Le Mee; Jean-Claude C. Taillant, Vaux le Penil, both of France

[73] Assignee: Societe Nationale d'Etude et de Construction de Moteurs d'Aviation S.N.E.C.M.A., Paris Cedex, France

[21] Appl. No.: 544,019

[22] Filed: Oct. 17, 1995

[30] Foreign Application Priority Data

Oct. 26, 1994 [FR] France ..... 94 12785

[51] Int. Cl.[6] ..... F01D 5/10

[52] U.S. Cl. ..... 416/190; 416/193 A; 416/500

[58] Field of Search ..... 416/190, 191, 416/193 A, 200 R, 500

[56] References Cited

U.S. PATENT DOCUMENTS

| | | | |
|---|---|---|---|
| 3,112,915 | 12/1963 | Morris . | |
| 3,119,595 | 1/1964 | Amerman et al. . | |
| 3,887,298 | 6/1975 | Hess et al. . | |
| 4,183,720 | 1/1980 | Brantley | 416/193 A |
| 4,457,668 | 7/1984 | Hallinger . | |
| 4,480,959 | 11/1984 | Bourguignon et al. . | |
| 4,872,812 | 10/1989 | Hendley et al. . | |
| 5,143,517 | 9/1992 | Vermont | 416/190 |
| 5,156,528 | 10/1992 | Bobo | 416/190 |
| 5,261,790 | 11/1993 | Dierz et al. | 416/500 |
| 5,284,421 | 2/1994 | Chlus et al. | 416/500 |
| 5,313,786 | 5/1994 | Chlus et al. | 416/500 |
| 5,478,207 | 12/1995 | Stec | 416/500 |
| 5,513,955 | 5/1996 | Barcza | 416/193 A |

FOREIGN PATENT DOCUMENTS

| | | |
|---|---|---|
| 0062558 | 10/1982 | European Pat. Off. . |
| 0089272 | 9/1983 | European Pat. Off. . |
| 2619158 | 2/1989 | France . |
| 2674569 | 10/1992 | France . |
| 786475 | 11/1957 | United Kingdom . |
| 2112466 | 7/1983 | United Kingdom . |
| 2116641 | 9/1983 | United Kingdom . |
| 2127104 | 4/1984 | United Kingdom . |

*Primary Examiner*—John T. Kwon
*Attorney, Agent, or Firm*—Bacon & Thomas

[57] ABSTRACT

A seal for sealing the gaps between adjacent turbine blade structures is disclosed in which the seal is disposed in a compartment formed between adjacent turbine blade structures having first and second sealing surfaces adjacent to a generally axially extending gap and a generally radially extending gap, respectively. The seal also has a thrust surface extending obliquely to a radius from the axis of rotation of the rotor disk to which the turbine blade structures are attached which is engaged with a reaction surface formed on a reaction member located in the compartment. During rotation of the rotor disk, centrifugal force acting in a radially outward direction is transmitted both radially and axially to a seal by contact between the reaction surface and the oblique thrust surface to cause the first sealing surface to seal the generally axially extending gap and the second sealing surface to seal the generally radially extending gap.

25 Claims, 8 Drawing Sheets

SEAL FOR GAS TURBINE ROTOR BLADES

BACKGROUND OF THE INVENTION

The present invention relates to a seal for sealing the axial and radial gaps between adjacent turbine blades on a gas turbine rotor disk.

Turbine or compressor blades of gas turbine engines are, in known manner, attached to the periphery of a rotor disk. The blades typically comprise an airfoil blade portion, a platform, a shank and a root that fits into a correspondingly shaped slot formed in the periphery of the rotor disk. The shank usually has a narrower cross-section than that of the root and is located between radially extending stiffeners extending from the platform. The stiffeners, together with the root subtend two cavities, one on the lower surface and the other on the upper surface.

The mounting of the blade structures on the rotor wheel typically allow gas leaks between the side edges of adjacent platforms near the gas flow path and through gaps formed between adjacent stiffeners upstream and downstream of the turbine rotor disks. Also, as is well known in the art, known turbine blades and seals have dampers eliminating the vibration of the blades during rotation of the rotor disk.

It is known to install seal devices in the cavities wherein such devices are solid and fabricated from metal or plastic. However, such known devices do not totally seal the leaks, especially the axial leaks near the stiffeners. Due to the centrifugal forces during rotation of the rotor disks, the known seal devices are pressed underneath the platform of the turbine blades and only seal the gap between adjacent platforms near the gas flow.

To limit vibration of the gas turbine engine blades during operation, it is known to use vibration dampeners. Such vibration dampeners may consist of polymer balancing masses affixed underneath the platforms and extending into the cavities. Another known solution is to add additional parts, such as upstream and downstream plates or flanges.

SUMMARY OF THE INVENTION

A seal for sealing the gaps between adjacent turbine blade structures is disclosed in which the seal is disposed in a compartment formed between adjacent turbine blade structures having first and second sealing surfaces adjacent to a generally axially extending gap and a generally radially extending gap, respectively. The seal also has a thrust surface extending obliquely to a radius from the axis of rotation of the rotor disk to which the turbine blade structures are attached which is engaged with a reaction surface formed on a reaction member located in the compartment. During rotation of the rotor disk, centrifugal force acting in a radially outward direction is transmitted both radially and axially to a seal by contact between the reaction surface and the oblique thrust surface to cause the first sealing surface to seal the generally axially extending gap and the second sealing surface to seal the generally radially extending gap.

The invention concerns an assembly of a rotary disk and a plurality of turbine blade structures affixed to the periphery of the rotor disk for use in a gas turbine engine and comprising a disk rotatably mounted so as to rotate about an axis of rotation having a plurality of affixing slots axially formed in the periphery of the disk to accommodate a plurality of turbine blade structures, each having a root received in the slot to affix the blade structures to the disk. Each turbine blade structure comprises a blade portion, a platform having two opposite lateral edges and a root connected to the platform by a shank. Adjacent turbine blades, when mounted on the rotary disk, have a side edge of one platform adjacent to a corresponding side edge of the adjacent turbine blade platform which define between them a generally axially extending gap.

Each turbine structure also comprises stiffeners extending radially from the platforms in planes substantially perpendicular to the axis of rotation of the rotor disk between the platform and the blade root on either side of the shank. The stiffeners are bounded by two radial edges and, in cooperation with the platform, the root and the shank, define cavities located on either side of the shank. When the turbine blade structures are attached to the rotor disks, the cavities of the two adjacent blade structures form a common compartment. The stiffeners for the two adjacent turbine blades are adjacent to each other and the adjacent sides of the stiffeners are spaced apart to form a generally radially extending gap.

The seal according to the present invention is located in the compartment and has a first sealing surface adjacent to the generally axially extending gap and a second sealing surface adjacent to the generally radially extending gap. The seal also has a thrust surface extending obliquely to the radially acting direction of the centrifugal force which bears against a reaction surface formed on a member also located in the compartment. Relative movement between the member and the seal during rotation of the rotor disk enables the radial acting centrifugal forces to be divided into a radial component and an axial component. The radial component of the force causes the first sealing surface to seal the generally axially extending gap and the axial component causes the second sealing surface to seal the generally radially extending gap.

Various embodiments of the seal and reaction member are encompassed by the instant invention. In a first embodiment, the seal substantially fills the compartment between the turbine blade structures, and has thereon both first and second sealing surfaces, as well as the oblique thrust surface. The seal has a recess in which is located the reaction member, which also comprises a moving balancing mass having the reaction surface. The balancing mass not only provides the centrifugal force to the oblique thrust surface, but acts as a damper for dampening vibration during rotation of the rotor disk.

In a second embodiment, the seal partially fills the common compartment and again encompasses both first and second sealing surfaces, as well as the oblique thrust surface. One or more locating arms extend into the compartment from a turbine blade structure to locate the seal as well as the reaction member which, again, comprises a balancing mass located within the compartment. One of the locating arms may act on both the reaction member and the seal to locate them in their desired positions relative to each other and relative to the axially and radially extending gaps. In this embodiment, as well as in the previous embodiment, the seal is formed by an element having a wall thickness, the thickness of the wall having the first and second sealing surfaces being less than the thickness of the wall having the oblique thrust surface.

In other embodiments, the seal may comprise a generally "L"-shaped member in which the legs of the "L" have the first and second sealing surfaces thereon. A separate protrusion having the oblique thrust surface is fixedly or removably attached to the seal and is located such that the oblique thrust surface contacts the reaction surface formed on an arm extending into the compartment from one of the turbine blade structures. A stop surface may be formed on another arm extending into the compartment from the turbine structure which bears against the protrusion element so as to position the element and the seal in a circumferential direction. In this embodiment, the protrusion member may comprise a balancing mass to dampen vibration of the rotor disk.

In a fourth embodiment, the seal is "L"-shaped as in the previous embodiment. The side edge of one of the adjacent turbine blade structures forms a stop surface which bears against a lateral side edge of the "L"-shaped seal. The adjacent platform of the adjacent turbine blade structure has an oblique second thrust surface in contact with a complimentary, oblique thrust surface formed on one of the legs of the "L"-shaped seal such that centrifugal force acting on the seal urges the seal into contact with the stop surface on the side of the blade platform through the oblique second thrust surface and second complimentary thrust surface. In this embodiment, the seal comprises a solid body which may also form a complimentary balancing mass in addition to the reaction member, which also comprises a balancing mass.

Locating arms may extend into the compartment from a turbine blade structure and act on both the seal and the reaction member to properly locate these elements with respect to each and with respect to the axially and radially extending gaps.

Alternatively, the stiffener of one turbine blade structure forms a main stop surface extending substantially axially which bears against a complimentary stop surface formed on a second leg of the "L"-shaped seal which has the second sealing surface. The stiffeners of an adjacent turbine blade structure form a main rest surface which extends substantially perpendicular to the main stop surface on the adjacent turbine structure and is in contact with a complimentary stop surface formed on the second leg of the "L"-shaped seal.

In this embodiment, the stiffener of a first turbine blade structure may define a generally radially extending guidance surface that engages a complimentary guidance surface formed on the reaction member. The adjacent stiffener of the adjacent turbine blade structure has a second main guidance surface which extends substantially perpendicularly to the first main guidance surface and which is in sliding contact with the second complimentary guidance surface formed on the reaction member.

In an alternative embodiment, the seal may be comprised of an elongated member having the first seal surface and a plate member having the second seal surface as well as the oblique thrust surface. The plate member is movably attached to the turbine blade structures whereby the oblique thrust surface is in contact with a reaction surface formed on a member extending from the elongated seal member.

DETAILED DESCRIPTION OF THE PREFERRED EMBODIMENT

Figure 1:
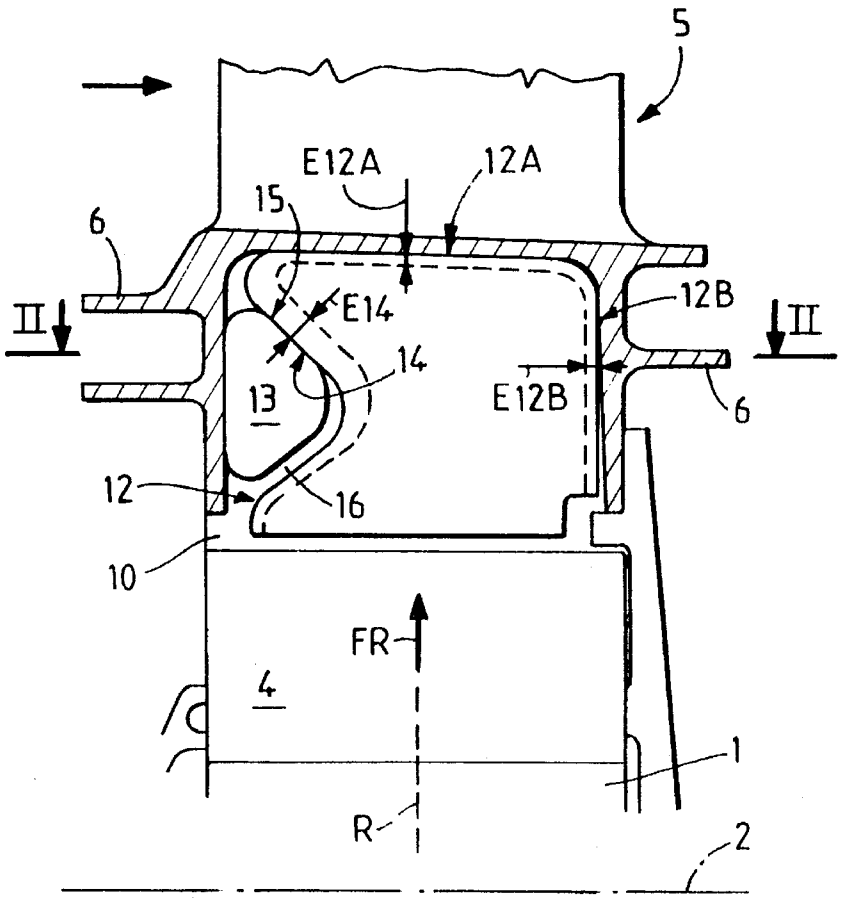
FIG. 1 is a partial, cross-sectional view of a turbine blade structure taken along line I—I in FIG. 2 of a first embodiment of the seal according to the present invention.
Figure 2:
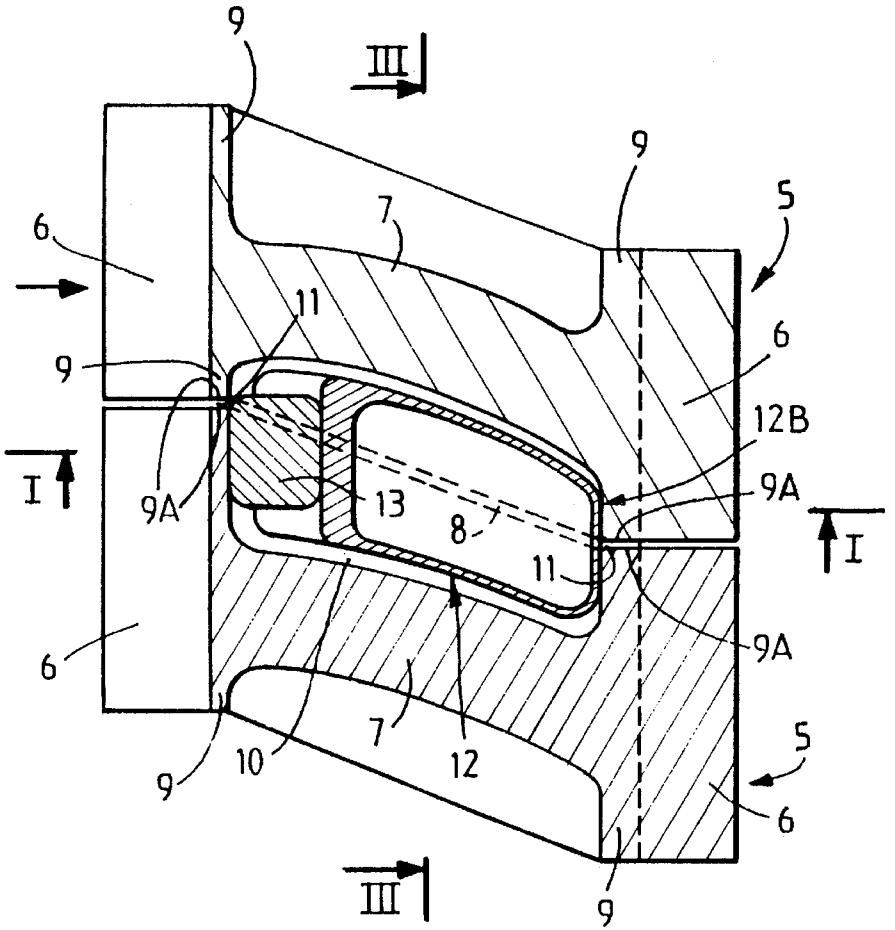
FIG. 2 is a cross-sectional view of the seal taken along line II—II in FIG. 1.
Figure 3:
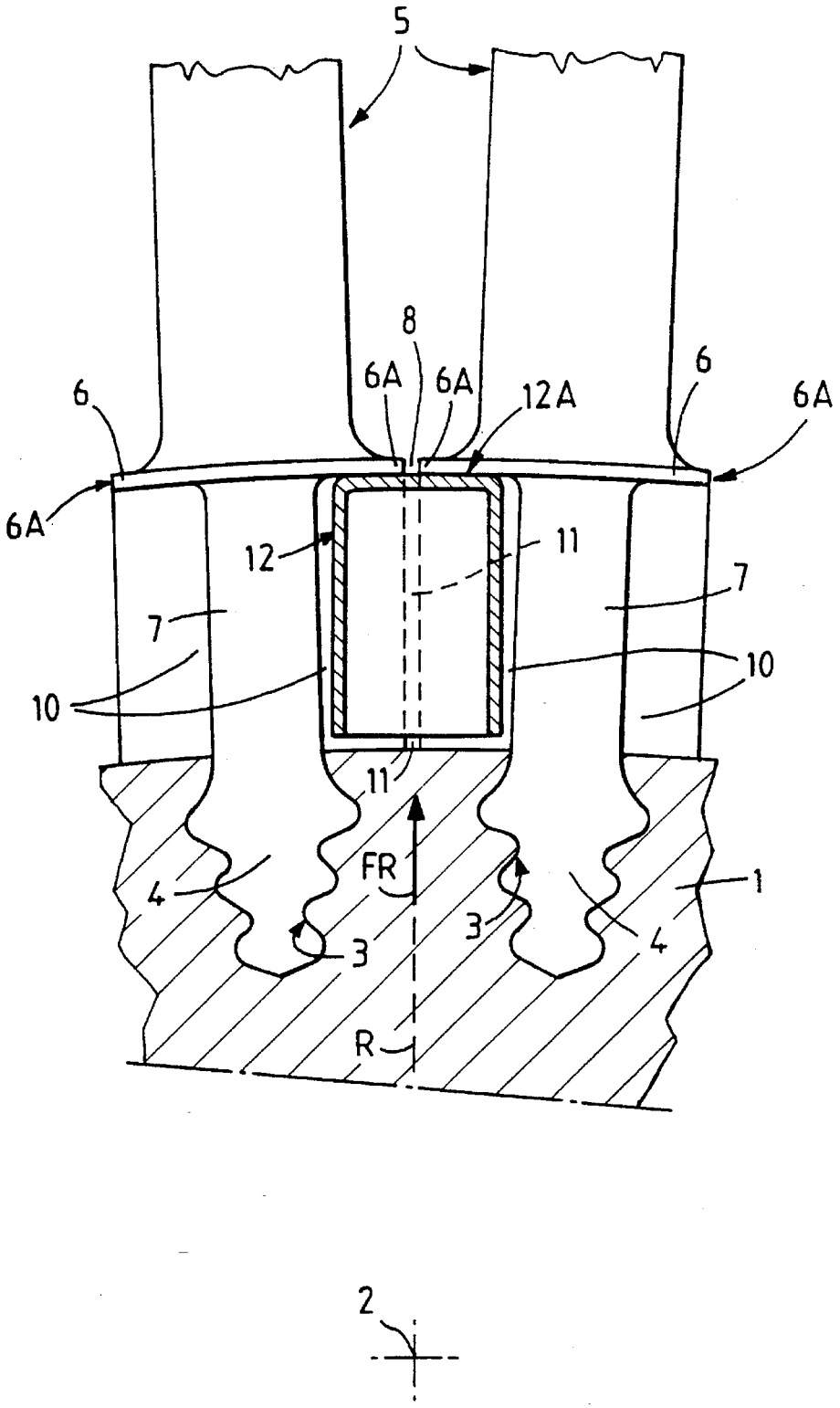
FIG. 3 is a cross-sectional view of the seal illustrated in FIGS. 1 and 2 taken along the lines III—III in FIG. 2.

The first embodiment of the invention is illustrated in FIGS. 1–3 comprises a rotary disk 1 rotatable about an axis of rotation 2 and having axially extending slots 3 circumferentially spaced apart about it's periphery to receive the root 4 of a gas turbine engine blade structure 5. The root 4 has a shape, for instance a dovetail shape, complimentary to that of the slots 3 in order to affix the blade structure 5 to the rotary disk 1.

Each blade structure 5 comprises a platform 6 having two opposite axially extending edges 6A extending substantially parallel to the axis 2 and a shank 7 connecting the root 4 to the platform 6. When the turbine blade structures 5 are attached to the rotary disk, one the axial edges 6A of one platform is spaced from, but adjacent to an axial edge 6A of an adjacent turbine blade structure 5 to form a generally extending axially gap 8.

Each blade structure 5 also comprises two stiffeners 9 extending in planes substantially perpendicular to the axis of rotation 2 between the platform 6 and the root 4 on either side of the shank 7. In cooperation with the platform 6, the root 4 and the shank 7, the stiffeners 9 define cavities located on either side of the shank 7. The cavities of two adjacent blade structures 5 are located adjacent to each other and form a common compartment 10. The adjacent stiffeners 9 from each of the adjacent turbine blade structures 5 have a generally radially extending edge 9A which together bound a generally radially extending gap 11.

A seal 12 is located inside the common compartment 10 and comprises a first sealing surface 12A located adjacent to the axially extending gap and a second sealing surface 12B located adjacent to the generally radially extending gap 11. The seal 12 also comprises a thrust surface 14 which extends obliquely to the radial direction R in which the centrifugal force FR acts during the rotation of rotaor disk 1. The oblique thrust surface 14 rests against a reaction surface 15 formed as part of reaction member 13. As will be described in more detail, centrifugal forces FR acting on movable reaction member 13 imparts a force on oblique thrust surface 14 having a radial component which causes the first sealing surface 12A to seal the axial gap 8, as well as an axially directed force component acting on the seal 12 such that second sealing surface 12B seals the generally radially extending gap 11.

The seal 12 substantially fills the entirety of the common compartment 10 and defines a recess 16, of which one of the surfaces comprises the oblique thrust surface 14. A moving balancing mass 13 is located within the clearance 16 such that its reaction surface 15 is in contact with the oblique thrust surface 14. Balancing mass 13 also acts as a damper to dampen the vibration during rotation of the rotary disk.

Figure 4:
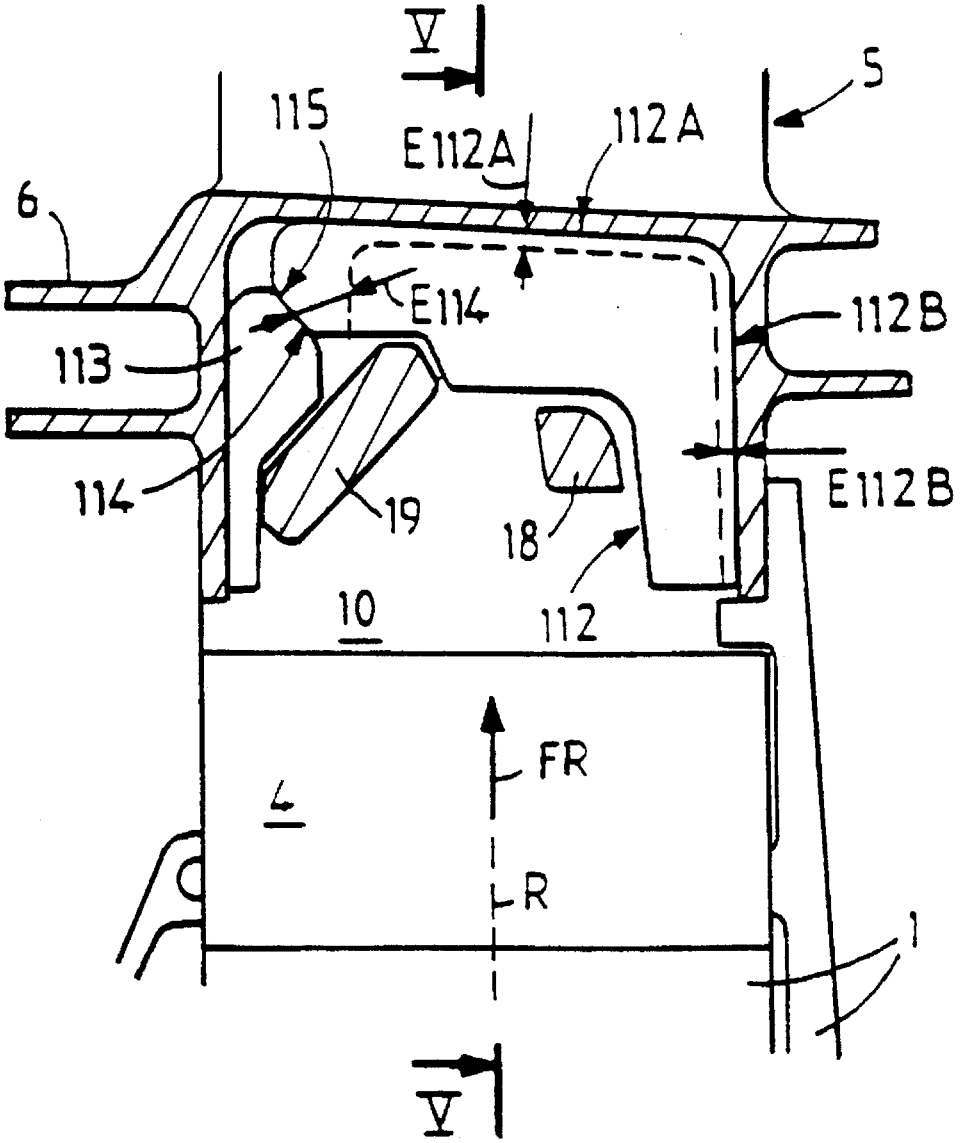
FIG. 4 is a partial, cross-sectional view similar to FIG. 1, but illustrating a second embodiment of the seal according to the present invention.
Figure 5:
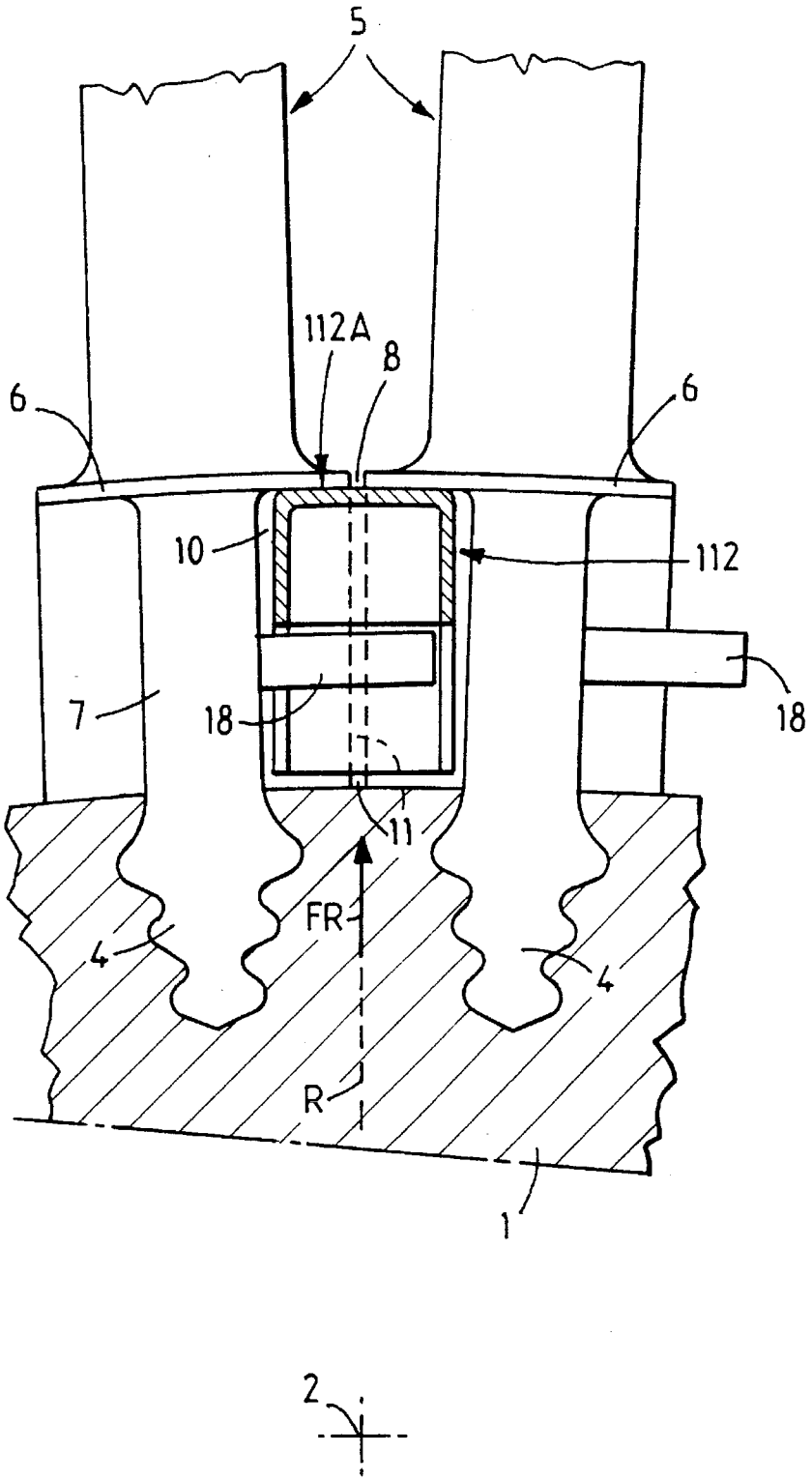
FIG. 5 is a cross-sectional view taken along line V—V in FIG. 4.

In a second embodiment illustrated in FIGS. 4 and 5, the seal 112 only partially fills the compartment 10 and has thereon first sealing surface 112A and second sealing surface 112B, as well as the oblique thrust surface 114. At least one locating arm 18 extends into the compartment 10 from one of the adjacent turbine blade structures 5 to locate and position the seal 112 such that the sealing surfaces 112A and 112B are adjacent to the axial gap 8 and the radial gap 11, respectively. A movable balancing mass 113 is located inside the compartment 10 having the reaction surface 115 in contact with the oblique thrust surface 114 and to prevent vibration during operation of the rotatably disk.

In this embodiment, a second locating arm 19, which also extends into the compartment 10 from one of the turbine blade structures 5 positions the balancing mass 113 such that the reaction surface 115 is located near, or in contact with, the oblique thrust surface 114. The second locating arm 19 also locates the seal 112 in cooperation with the first locating arm 18.

In either of the first and second embodiments, the seal 12, 112 consists of a hollow body having a wall thickness E14, E114 which, opposite the oblique thrust surface 14, 114 has a greater thickness than the thicknesses E12A, E12B, E112A, E112B of the wall having the first and second sealing surfaces 12A 112A and 12B, 112B respectively.

Figure 6:
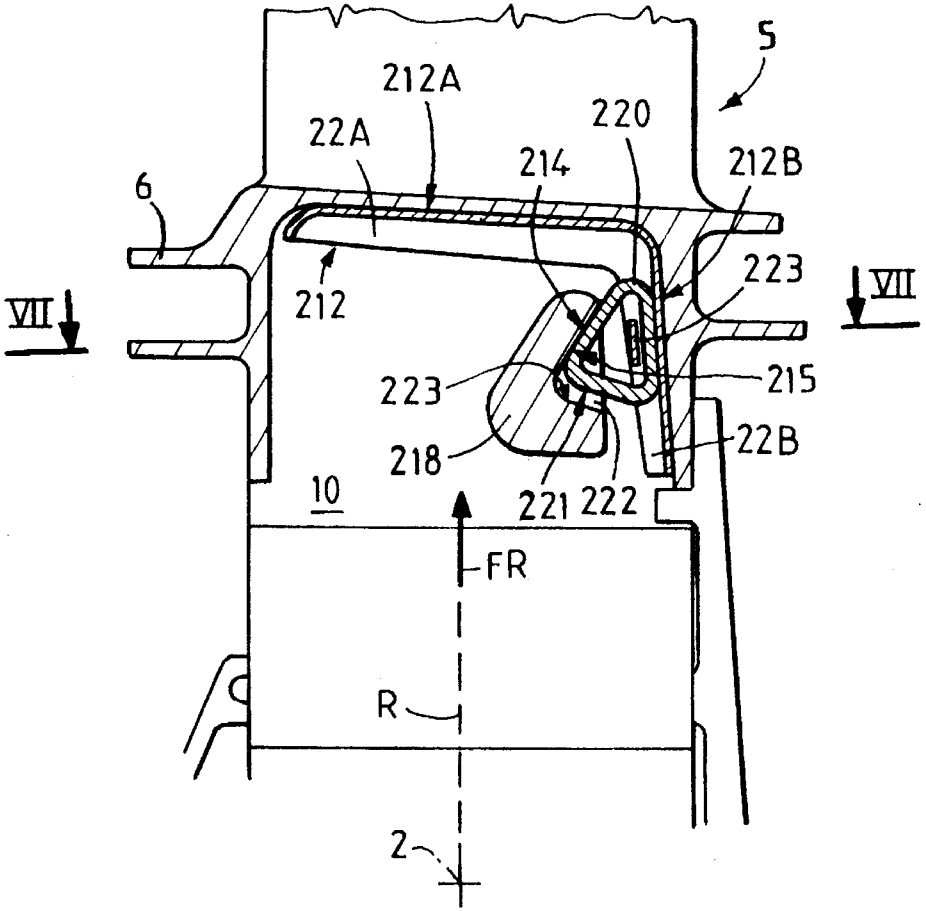
FIG. 6 is a cross-sectional view similar to FIG. 1, taken along the line VI—VI of FIG. 7 and illustrating a third embodiment of the invention.
Figure 7:
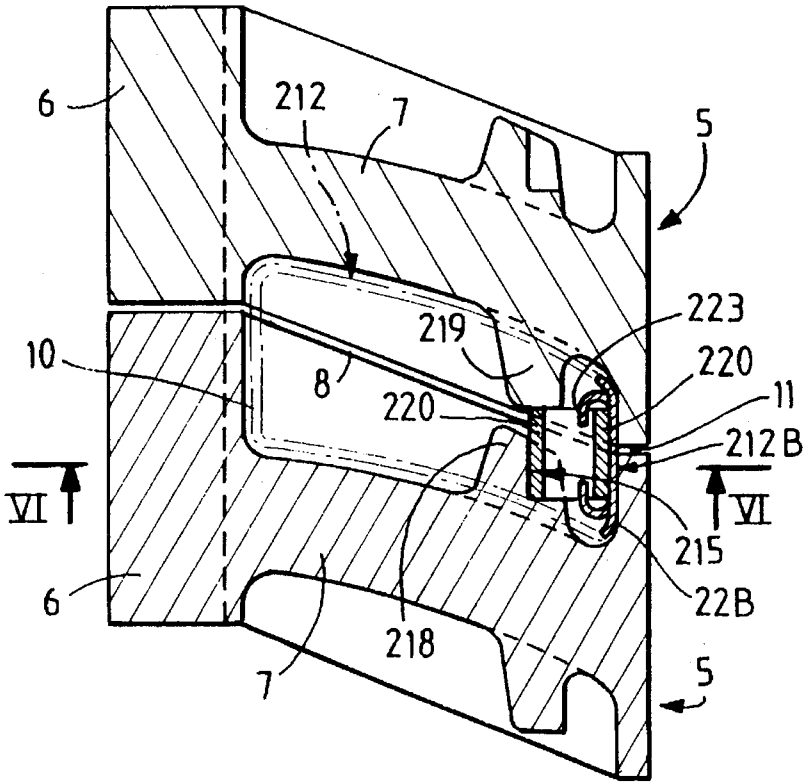
FIG. 7 is a cross-sectional view taken along line VII—VII in FIG. 6.

In the third embodiment, illustrated in FIGS. 6 and 7, the seal 212 located within the compartment 10 has a substantially "L"-shaped cross-sectional configuration with the two legs 22A, 22B of the "L" having the first and second sealing 212A and 212B, respectively. The seal also has a protrusion 220 attached thereto wherein the protrusion 220 has the oblique thrust surface 214 thereon. A first locating arm 218 extends into the compartment from one of the adjacent turbine blade structures 5 and has the reaction surface 215 thereon, in contact with the oblique thrust surface 214. The protrusion 220 also has a stop surface 221 extending at an angle from the oblique thrust surface 214 and located so as to have a generally radially extending clearance 222 with a complimentary stop surface 223 formed on the locating arm 218.

A second locating arm 219 extends into the compartment from a turbine blade structure 5 to act as a stop by bearing against a side of the protrusion 220 inside the clearance 222. The protrusion 220 is formed separately from the seal 212 and is attached to the seal 212 by detachable fasteners 223, which may comprise a clip affixed to the arm 22B of seal 212. In this embodiment, the protrusion 220 may also comprise a balancing mass to act as a vibration dampener. Again, the seal 212 is formed as a hollow body.

Figure 9:
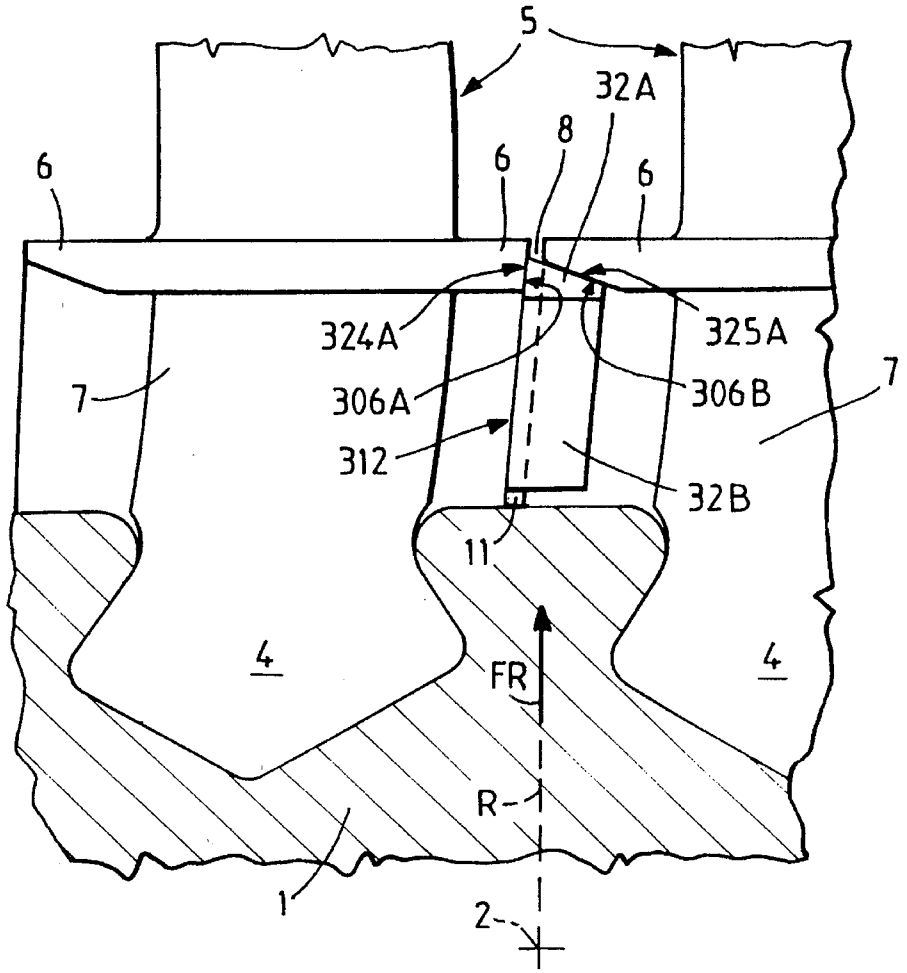
FIG. 9 is a cross-sectional view taken along line IX—IX in FIG. 8.
Figure 8:
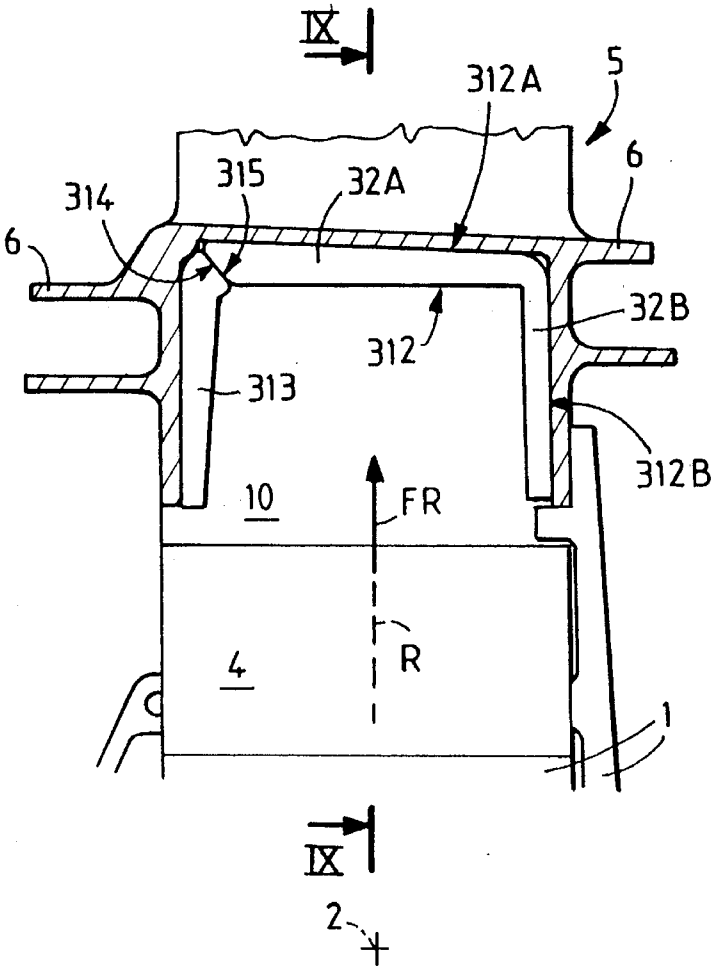
FIG. 8 is a partial, cross-section view similar to FIG. 1 illustrating a fourth embodiment of the seal according to the present invention.

A fourth embodiment of the invention is illustrated in FIGS. 8 and 9, wherein it can be seen that the seal 312 in the compartment 10 also has a substantially "L"-shaped cross-sectional configuration with legs 32A and 32B having the sealing surfaces 312A and 312B, respectively. A distal end of the leg 32A has the oblique thrust surface 314 thereon which, as in the previously described embodiments, is in contact with a reaction surface 315 formed on a main balancing mass 313, also located in the common compartment.

One of the side edges of platform 6 forms a main stop surface 306A extending substantially axially. A second edge on the adjacent turbine blade structure 5 forms a second thrust surface 306B extending obliquely relative to the first main stop surface 306A. The leg 32A of the seal 312 has a first complimentary stop surface 324A bearing against the first main stop surface 306A and a second complimentary thrust surface 325A in sliding contact with the second main thrust surface 306B, such that the centrifugal force FR causes the second complimentary thrust surface 325A to slide on the second complimentary thrust surface 306B to urge the stop surfaces 324A and 306A into contact with each other so as to seal the axial gap 8.

Figure 11:
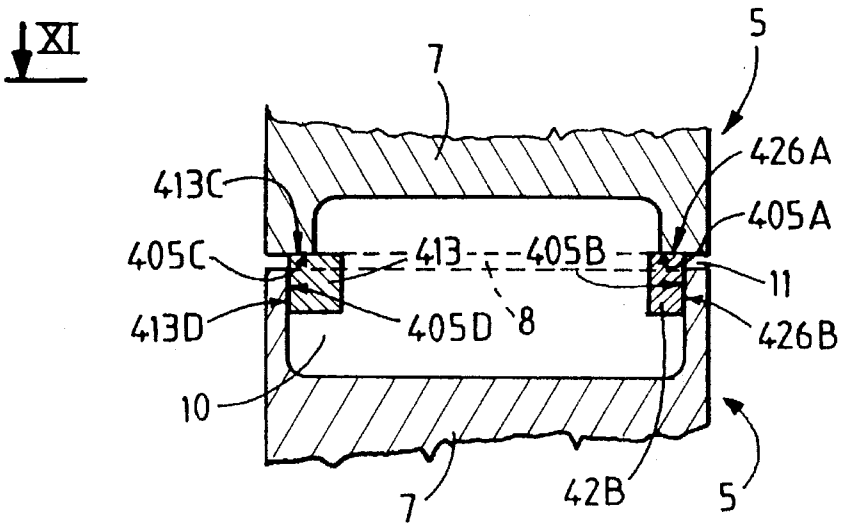
FIG. 11 is a cross-sectional view taken along line XI—XI in FIG. 10.
Figure 10:
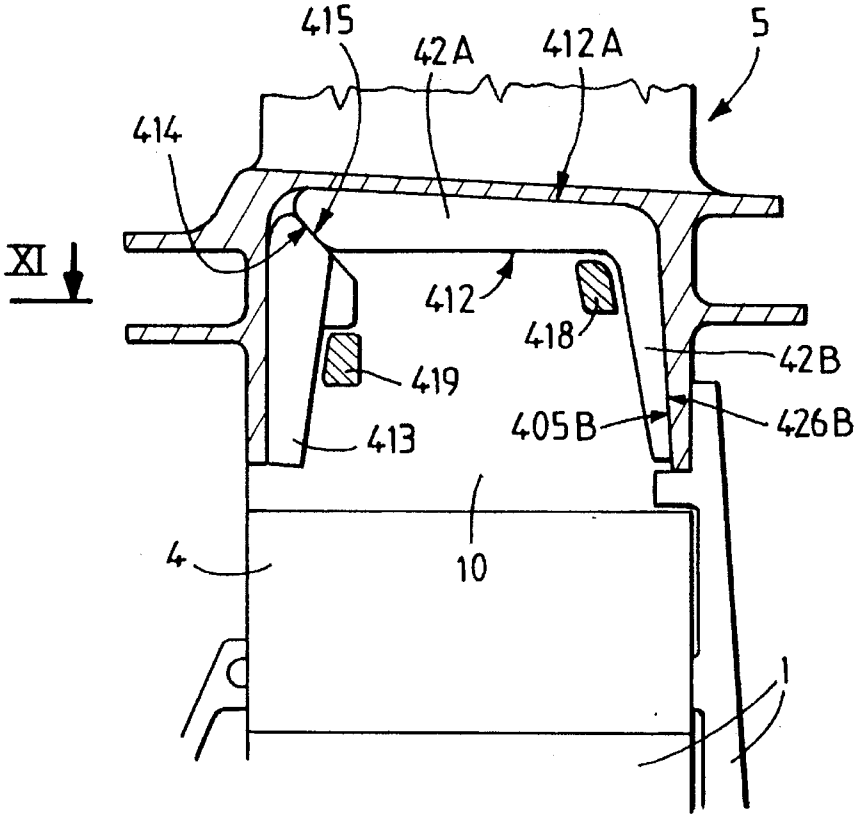
FIG. 10 is a partial cross-sectional view similar to FIG. 1, but illustrating a fifth embodiment of the seal according to the present invention.

A fifth embodiment of the seal according to the present invention is illustrated in FIGS. 10 and 11. As in the previously described embodiment, the seal 412 has an "L"-shaped cross-sectional configuration with legs 42A, 42B having the first and second sealing surfaces 412A and 412B thereon. The oblique thrust surface 414 is formed on a distal end of the leg 42A and is in contact with the reaction surface 415 formed on reaction member balancing mass 413. The shank 7 of one of the adjacent turbine blade structures 5 has a generally axially extending main thrust surface 405A located on one side of the gap 11. The shank 7 of the adjacent turbine blade structure 5 has a rest surface 405B thereon which extends substantially perpendicularly to the main thrust surface 405A.

The leg 42B of seal 412 has a complimentary stop surface 426A and a complimentary thrust surface 426B located in a sealing manner against the main stop surface 405A and the rest surface 405B, respectively, to thereby seal the generally radially extending gap 11, while also sealing the axial gap 8 by means of leg 42A and sealing surface 412A.

In both the fourth and fifth embodiments, the turbine blade structures 5 may have formed thereon a first main guidance surface 405C extending in a substantially axial direction on one of the turbine blade structures, while the adjacent turbine blade structures has a second main guidance surface 405D thereon extending substantially 90° from the first main guidance surface 405C. The balancing mass 413 has thereon first and second complimentary guidance surfaces 413C and 413D, respectively, which are in contact with, and guided by the first and second main guidance surfaces 405C and 405D. The balancing mass 413 is guided in a sliding manner thereby. Similar to the embodiment illustrated in FIGS. 8 and 9, the embodiment in FIGS. 10 and 11 may have the arm 42A with the oblique thrust surface 414 cooperating with the reaction surface 415 formed on the balancing mass 413.

The embodiments illustrated in FIGS. 8 and 9 may also comprise locating arms to keep the seals and the balancing masses in their proper locations. As illustrated in FIG. 10, locating arms 418 and 419 extend into the compartment 10 from one of the turbine blade structures 5 to locate the seal 412 and the main balancing mass 413. The seals 312 and 412 may also comprise a solid body and constitute a complimentary balancing mass.

Figure 13:
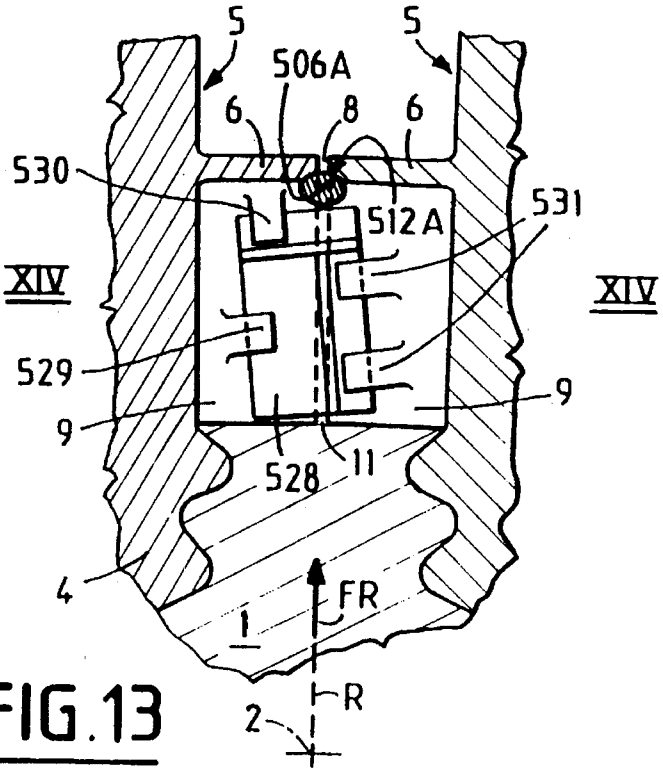
FIG. 13 is a cross-sectional view taken along the line XIII—XIII in FIG. 12.
Figure 14:
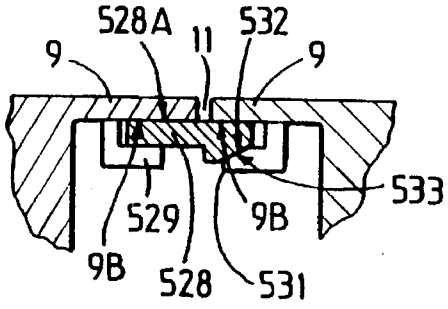
FIG. 14 is a partial, cross-sectional view taken along line XIV—XIV in FIG. 13.
Figure 12:
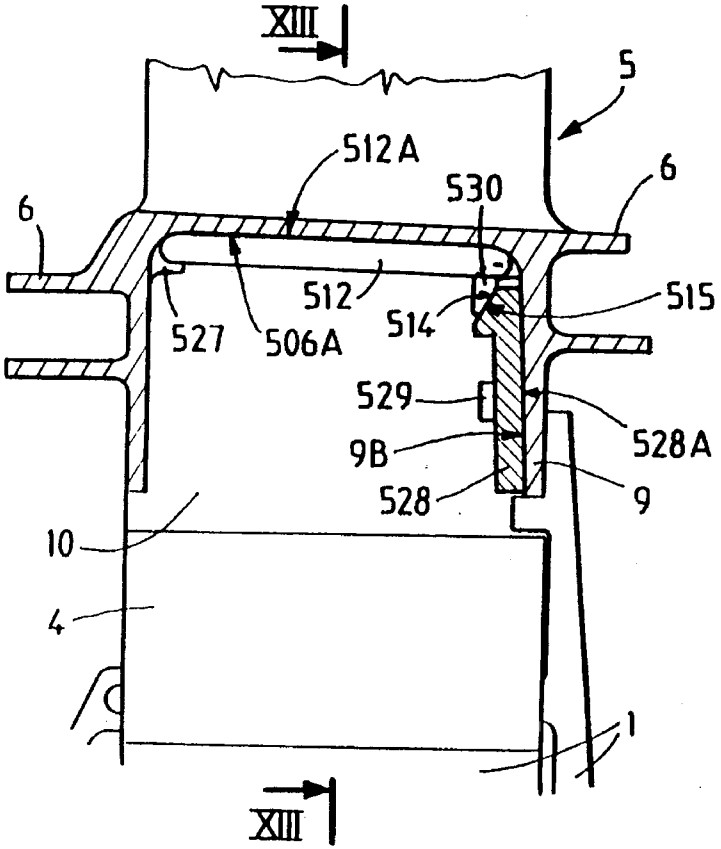
FIG. 12 is a partial cross-sectional view similar to FIG. 1, illustrating a sixth embodiment of the seal according to the present invention.

A sixth embodiment of the invention is illustrated in FIGS. 12–14. As can be seen, the seal comprises two distinct components, an elongated member 512 having the sealing surface 512A pressing against the inside surfaces 506A of the platforms 6 so as to seal the axial gap 8. Guides 527 rigidly affix to the turbine blade structure 5 locate the elongated member 512 in its proper location. Plate 528 comprises the second component of the seal and is located inside the common compartment 10 and movably attached to adjacent turbine blade structures 5. The plate 528 has sealing surface 528A in sealing contact against each of the portions of the inside surfaces 9B of adjacent stiffeners 9 so as to seal the generally radially extending gap 11. The plate 528 also has the oblique thrust surface 514 bearing against the reaction surface 515 formed on arm 530 rigidly attached to a turbine blade structure 5. First arms 529 and 531 are also rigidly attached to the turbine blade structures 5 and serve to slidably attach the plate 528 to the turbine blade structure. The location of the inside surfaces 9B of the two adjacent stiffeners 9 are located in a common plane thereby enabling the sealing surface 528A to also be planar in configuration. The first arm 531 and the plate 528 are also fitted with complimentary intergaging wedge surfaces 532 and 533 which cooperate to locate the plate 538 in place relative to one of the turbine blade structures 5.

In all of the embodiments of the present invention, when the disk 1 is rotated about axis 2, the radially outwardly directed centrifugal force FR acts on the balancing mass 13, 113, 223, 313, 413 or 528 such that the force transmitted to the oblique thrust surface 14, 114, 214, 314, 414 and 514 by the reaction surface 15, 115, 215, 315, 415 and 515 has an axial component causing the second sealing surfaces 12B, 112B, 212B, 312B, 426B and 528B to seals the radial gap 11, and a radial component whereby the first sealing surface 12A, 112A, 212A, 412A and 512B seal the axial gap 8.

If the seal 12 substantially fills the compartment 10 (as illustrated in FIGS. 1–3) the balancing mass 13 and the seal 12 may be kept in position without resorting to locating arms. In other instances, the locating arms retain the sealing surfaces 112A, 112B, 212A, 212B, 412A, 426B, 512A and 528A opposite their respective axial and radial gaps 8 and 11 until the centrifugal force urges them into sealing engagement. In the embodiment illustrated in FIG. 8, a small projection from the rotary disk 1 keeps the seal 312 in position in cooperation with the balancing mass 313.

The present invention not only achieves effective sealing, but also increases vibration dampening by providing balancing masses. The embodiments illustrated in FIGS. 8–10 also assures sealing of the gaps even when the sealing surfaces of adjacent turbine blade structures are not coplanar.

The foregoing description is provided for illustrative purposes only and should not be construed as in any way limiting this invention, the scope of which is defined solely by the appended claims.

We claim:

1. A seal for sealing gaps between adjacent turbine blade structures attached to a rotor disc rotatable about an axis, the adjacent turbine blade structures forming a generally axially extending gap and a generally radially extending gap therebetween, the seal comprising:

a) a compartment formed by adjacent turbine blade structures;

b) seal means located in the compartment and having a first sealing surface adjacent to the generally axially extending gap, a second sealing surface adjacent to the generally radially extending gap and a thrust surface extending obliquely to a radius from the axis; and c) a member in the compartment having a reaction surface located such that, during rotation of the rotor disc, centrifugal force in a radial direction is transmitted radially and axially to the seal means via contact between the reaction surface and the oblique thrust surface, thereby causing the first sealing surface to seal the generally axially extending gap and the second sealing surface to seal the generally radially extending gap.

2. The seal of claim 1 wherein the seal means substantially fills the compartment and has a recess with the oblique thrust surface forming a side of the recess and wherein the member comprises a balancing mass movably located in the recess.

3. The seal of claim 1 further comprising a locating arm extending into the compartment from one of the turbine blade structures and acting on the seal means so as to locate the first sealing surface adjacent to the generally axially extending gap and the second sealing surface adjacent to the generally radially extending gap.

4. The seal of claim 3 wherein the member comprises a balancing mass movably located in the compartment.

5. The seal of claim 4 further comprising a second locating arm extending into the compartment from one of the turbine blade structures acting on the balancing mass to locate the reaction surface adjacent to the oblique thrust surface.

6. The seal of claim 5 wherein the second locating arm also acts on the seal means so as to locate the first sealing surface adjacent to the generally axially extending gap and the second sealing surface adjacent to the generally radially extending gap.

7. The seal of claim 1 wherein the seal means is formed by a wall having a wall thicknesses at the oblique thrust surface greater than the wall thickness at the first and second sealing surfaces.

8. The seal of claim 1 wherein the seal means has a generally "L"-shaped configuration with surfaces of the legs of the "L"-shape forming the first and second sealing surfaces.

9. The seal of claim 8 further comprising a protrusion element attached to the "L"-shaped seal, the protrusion element having the oblique thrust surface thereon.

10. The seal of claim 9 further comprising an arm extending into the compartment from one of the turbine blade structures, the arm having the reaction surface thereon.

11. The seal of claim 10 further comprising a second arm extending into the compartment from one of the turbine blade structures in contact with the protrusion element so as to limit circumferential movement of the seal relative to the turbine blade structure.

12. The seal of claim 9 further comprising means to removably attach the protrusion element to the "L"-shaped seal.

13. The seal of claim 9 wherein the protrusion element comprises a balancing mass to dampen vibration of the rotor disc.

14. The seal of claim 8 wherein the oblique thrust surface is located on a distal end of the leg having the first sealing surface.

15. The seal of claim 14 wherein the member bearing the reaction surface comprises a balancing mass to dampen vibration of the rotor disc.

16. The seal of claim 14 wherein the first leg of the "L"-shaped seal has a second oblique thrust-surface and further comprising:

a) a platform on each turbine blade structure, each platform having generally axially extending first and second side edges, a first side edge forming a main stop surface in contact with the first leg of the "L"-shaped seal; and, b) a second reaction surface formed on the platform adjacent the second side edge such that contact between the second reaction surface and second oblique thrust surface urges the "L"-shaped seal into contact with the main stop surface.

17. The seal of claim 14 further comprising:

a) a main stop surface on a first turbine blade structure extending substantially axially;

b) a main rest surface formed on a second turbine blade structure adjacent to the main stop surface, the main rest surface extending substantially perpendicular to the main stop surface;

c) a complementary stop surface formed on the second leg of the "L"-shaped seal having the second sealing surface so as to contact the main stop surface; and, d) a complementary thrust surface formed on the second leg of the "L"-shaped seal having the second sealing surface so as to contact the main rest surface.

18. The seal of claim 14 further comprising:

a) a first guidance surface on a first turbine blade structure extending substantially axially;

b) a second guidance surface on a second turbine blade structure adjacent to the first guidance surface and extending substantially perpendicular to the first guidance surface; and, c) first and second complementary guidance surfaces on the member movably contacting the first and second guidance surfaces, respectively.

19. The seal of claim 14 further comprising:

a) a first arm extending into the compartment from the turbine blade structure so as to position the "L"-shaped seal adjacent to the axially extending and radially extending gaps; and, b) a second arm extending into the compartment from the turbine blade structure so as to position the reaction surface of the member adjacent to the oblique thrust surface.

20. The seal of claim 14 wherein the "L"-shaped seal comprises a balancing mass to dampen vibration of the rotor disc.

21. The seal of claim 1 wherein the seal means comprises:

a) an elongated member located adjacent to the generally axially extending gap and having the first sealing surface; and, b) a plate member located adjacent to the generally radially extending gap and having the second sealing surface.

22. The seal of claim 21 further comprising first arms extending into the compartment so as to movably attach the plate member to the turbine blade structure.

23. The seal of claim 22 wherein the plate member has the oblique thrust surface and furtjer comprising a second arm extending from the elongated member and having the reaction surface thereon.

24. The seal of claim 21 wherein the second sealing surface is substantially planar.

25. The seal of claim 22 further comprising first and second oblique wedge surfaces formed on the plate member and at least one first arm in contact with each other.

* * * * *